US007024886B1

(12) United States Patent
Ito

(10) Patent No.: US 7,024,886 B1
(45) Date of Patent: Apr. 11, 2006

(54) ORNAMENT

(75) Inventor: Takashi Ito, Nishinomiya (JP)

(73) Assignee: Rokko Pearl Trading Co., Ltd., Hyogo (JP)

( * ) Notice: Subject to any disclaimer, the term of this patent is extended or adjusted under 35 U.S.C. 154(b) by 159 days.

(21) Appl. No.: 10/169,372

(22) PCT Filed: Nov. 6, 2000

(86) PCT No.: PCT/JP00/07793

§ 371 (c)(1),
(2), (4) Date: Jul. 1, 2002

(87) PCT Pub. No.: WO02/35958

PCT Pub. Date: May 10, 2002

(51) Int. Cl.
*A44C 5/00* (2006.01)

(52) U.S. Cl. ..... 63/3; 59/80; 63/41

(58) Field of Classification Search ..... 63/3, 63/3.1, 3.2, 4, 1.11, 1.16, 1.17, 1.18, 11, 21, 63/23, 38–41; 24/116 A, 601.8, 601.9, 298–301, 24/3.13, 3.4, 116 R, 115 H, 115 K, 664; 59/80–82

See application file for complete search history.

(56) References Cited

U.S. PATENT DOCUMENTS 1,059,520 A * 4/1913 Blomstrom ..... 24/664
1,578,940 A * 3/1926 Wacha ..... 24/116 A
1,720,472 A * 7/1929 Gagnon ..... 24/116 A
2,296,197 A * 9/1942 Bloom et al. ..... 24/3.13
2,521,589 A * 9/1950 Livingston ..... 63/20
2,529,058 A * 11/1950 Tell et al. ..... 33/555.4
2,545,428 A * 3/1951 Liautaud ..... 2/452
2,930,209 A * 3/1960 Altman ..... 63/1.16
3,094,754 A * 6/1963 Wayne ..... 24/116 R
3,114,187 A * 12/1963 Wayne ..... 24/116 A
3,168,768 A * 2/1965 Bohlinger et al. ..... 24/116 A
3,170,311 A * 2/1965 Raphael ..... 63/3.1

(Continued)

FOREIGN PATENT DOCUMENTS

EP 250321 * 12/1987

(Continued)

*Primary Examiner*—Jack W. Lavinder
(74) *Attorney, Agent, or Firm*—Wenderoth, Lind & Ponack, L.L.P.

(57) ABSTRACT

The hook 5, as shown in FIG. 3, FIG. 4 and FIG. 5, serves to latch between the pearls 2 at an optional position in the above-defined predetermined section of the necklace 1. Referring to FIG. 3 and FIG. 5, the hook 5 has an open end 51 whose opening is smaller than the outer diameter of the spacers 4. Opposite to the open end 51 and at an innermost area of the hook 5, the hook 5 also has a spacer fitting area 52 which is defined by a curve that matches an external circumference of the spacers 4. Specifically, as shown in FIG. 5 a width dimension of the spacer fitting area 52 is substantially equal to a width dimension of the spacer. The hook 5 has a smooth surface and such a thickness as to be comfortably inserted between the pearls 2. Thus, the hook 5 avoids damaging the pearls 2.

19 Claims, 7 Drawing Sheets

U.S. PATENT DOCUMENTS 3,208,238 A * 9/1965 Spitzer ..... 63/3.1
3,225,565 A * 12/1965 Bohlinger et al. ..... 63/3.2
3,957,039 A * 5/1976 Ehren ..... 601/132
4,530,221 A * 7/1985 Weinberg ..... 63/3.2
4,829,787 A * 5/1989 Yoda ..... 63/3
5,007,252 A * 4/1991 Mochizuki ..... 63/3
5,018,250 A * 5/1991 Schroder ..... 24/116 A
5,528,909 A * 6/1996 Tonakawa ..... 63/3
5,632,163 A * 5/1997 Inoue ..... 63/12
5,669,242 A * 9/1997 Cayton ..... 63/21
5,979,184 A * 11/1999 Razza ..... 63/1.11
6,349,568 B1 * 2/2002 Ito ..... 63/3

FOREIGN PATENT DOCUMENTS

| | | |
|---|---|---|
| JP | 52-124894 | 9/1977 |
| JP | 62-298305 | 12/1987 |
| JP | 9-299117 | 11/1997 |
| JP | 10-313920 | 12/1998 |
| JP | 2000-270913 | 10/2000 |

* cited by examiner

ORNAMENT

TECHNICAL FIELD

The present invention relates to an accessory. More particularly, the present invention relates to an accessory, such as a necklace or a bracelet, which is a string of multiple gems including pearls, corals, jades, diamonds and emeralds, with the loop size being freely adjustable in the process where the accessory is put on.

BACKGROUND ART

As an example of accessories, ready-made pearl necklaces are available in four types of length: choker (about 35 cm), princess (about 40–43 cm) matinee (about 53 cm), and opera (71 cm). The choker, which is the shortest among the four types of necklaces, rests most closely around the neck, and the princess, the matinee and the opera fall from the neck more deeply in the order mentioned. Naturally, the degree of fall depends on wearer's physique and her clothes of the day. Accordingly, a wearer selects a necklace of suitable length which is proportionate to her physique and which matches the clothes to be worn with the necklace. However, because pearl necklaces are generally expensive, it is not easy to own all types of necklaces mentioned above. Hence, in reality, a wearer is not free to make such selection. This reality can be overcome if the loop size of a necklace is freely adjustable. Nevertheless, a necklace is usually equipped with a pair of clasps on both ends and put on the body by engaging the clasps together. Such a necklace cannot adjust its loop size.

To solve this problem, various suggestions have been made for necklaces which can freely adjust their loop size. For example, as disclosed in Japanese Patent Laid-open Publication No. S60-207606, Japanese Patent Laid-open Publication No. S60-207607, and Japanese Utility Model Publication No. S48-41600, one end of a necklace is equipped with a clasp which is capable of pinching a spherical body of the necklace. The loop size of this necklace can be freely adjusted by allowing the clasp to pinch any optional spherical body at the other end of the necklace. To give further examples, as disclosed in Japanese Utility Model Registration No. 3041020 and Japanese Utility Model Registration No. 3060035, one end of a necklace is equipped with a clasp which is capable of hanging on a thread which strings multiple spherical bodies. The loop size of this necklace can be freely adjusted by allowing the clasp to hang on the string at any optional position on the other end of the necklace. In addition, Japanese Utility Model Laid-open Publication No. S52-124894 discloses a necklace which combines these two manners.

However, these conventional necklaces have the following problems. In the case where a clasp provided at one end of a necklace is arranged to pinch any optional spherical body at the other end of the necklace, the clasp is likely to mar the spherical body, spoiling the value of the necklace. For a pearl necklace, in particular, generation of flaws is critical.

As for the case where a clasp provided at one end of a necklace is arranged to hang on the string at any optional position on the other end of the necklace, the clasp damages the string every time the necklace is put on and off. In the course of repeated use, the string may finally break. Particularly, the string used in a pearl necklace, which is generally a silk thread or the like, is more likely to break.

Breakage of a thread is a serious problem, considering a higher durability is demanded for a more valuable necklace.

Inevitably, the necklace combining these two manners experiences the problems of the both.

Besides, the clasps employed in all of the above necklaces have extremely complex structures. Hence, the necklaces not only increase the cost for the clasps but also complicate the procedures for putting on and removing the necklaces. In this respect, it should be particularly understood that a wearer has to put on and off the necklace around the neck where her view is very limited. Under such circumstances, complicated wearing and removing procedures are critical disadvantages for necklaces. What is worse, an aged or disabled person finds it more difficult to put on and off such necklaces.

Additionally, the clasps in all of these necklaces are apparently visible while the necklace is worn, so that others can notice that the loop size is adjusted. Thus, these necklaces have to sacrifice the overall design.

The present invention is made in order to solve the conventional problems as above. An object of the invention is to provide an accessory whose loop size is freely adjustable and which protects gems from being damaged by a clasp.

Another object of the present invention is to provide a highly durable accessory which protects a thread from being damaged by a clasp in the process where the accessory is put on and off, so that the thread is unlikely to break for a long period.

Yet another object of the present invention is to provide an accessory which can be put on and off by remarkably easy procedures, so that an aged or disabled person can put it on and off easily.

Still another object of the present invention is to provide an accessory in which a hook at the joint of the loop is totally invisible while the necklace is worn, so that others may less likely to notice that the loop size is adjusted.

DISCLOSURE OF THE INVENTION

An accessory concerning the present invention can form a loop in a process where the accessory is put on, its loop size being freely adjustable in the process where the accessory is put on. This accessory comprises: a multiplicity of gems each having a through hole; a thread which is pulled through the through hole of each gem, so as to string the gems in a row; spacers made of an elastic member and mounted on the thread between the gems, the spacers being provided at least in a predetermined section at one end of the thread; a hook having an open end whose opening is smaller than an outer diameter of the spacers, and also having a spacer fitting area which locates opposite to the open end and at the innermost area of the hook, the spacer fitting area being defined by a curve which matches an external circumference of the spacers; and linking means for rotatably linking the hook with the other end of the thread.

This accessory may further comprise an ornament which is attached to the hook so as to locate behind the hook, wherein, when the hook is inserted between optional gems in the predetermined section and engaged with the spacer between the optional gems, the ornament hides engagement between the hook and the spacer.

As mentioned above, the hook has a simple structure and rotatably linked with the other end of the thread by the linking means. Therefore, in the process of putting on the accessory, a wearer can form a loop of desired size simply by holding the hook between fingers and fitting it between any optional gems at the other end. In the formed loop, the hook between the gems engages nothing other than the spacer, without pinching any gem nor contacting the thread, so that the hook does not damage the gems and the thread. Accordingly, the accessory ensures an excellent durability, with keeping the brilliance of the gems for a long period and preventing thread breakage. Besides, in the formed loop, the ornament attached behind the hook hides the engagement between the hook and the spacer, and makes the joint of the loop less visible. As a result, others are less likely to notice that the loop size is adjusted. Moreover, because the spacer made of an elastic member fits in the innermost area of the hook and thereby prevents the hook from coming off unexpectedly, there is no fear of dropping and losing the accessory. To put off the accessory, the deformable spacer made of an elastic member allows the hook to disengage from the spacer without difficulty. Thus, the removal procedure is simple as well.

BEST MODE FOR CARRYING OUT THE INVENTION

Hereinafter, an embodiment of the present invention is described with reference to drawings. In the description of this embodiment, the invention is understood to be applied to a pearl necklace.

Figure 1:
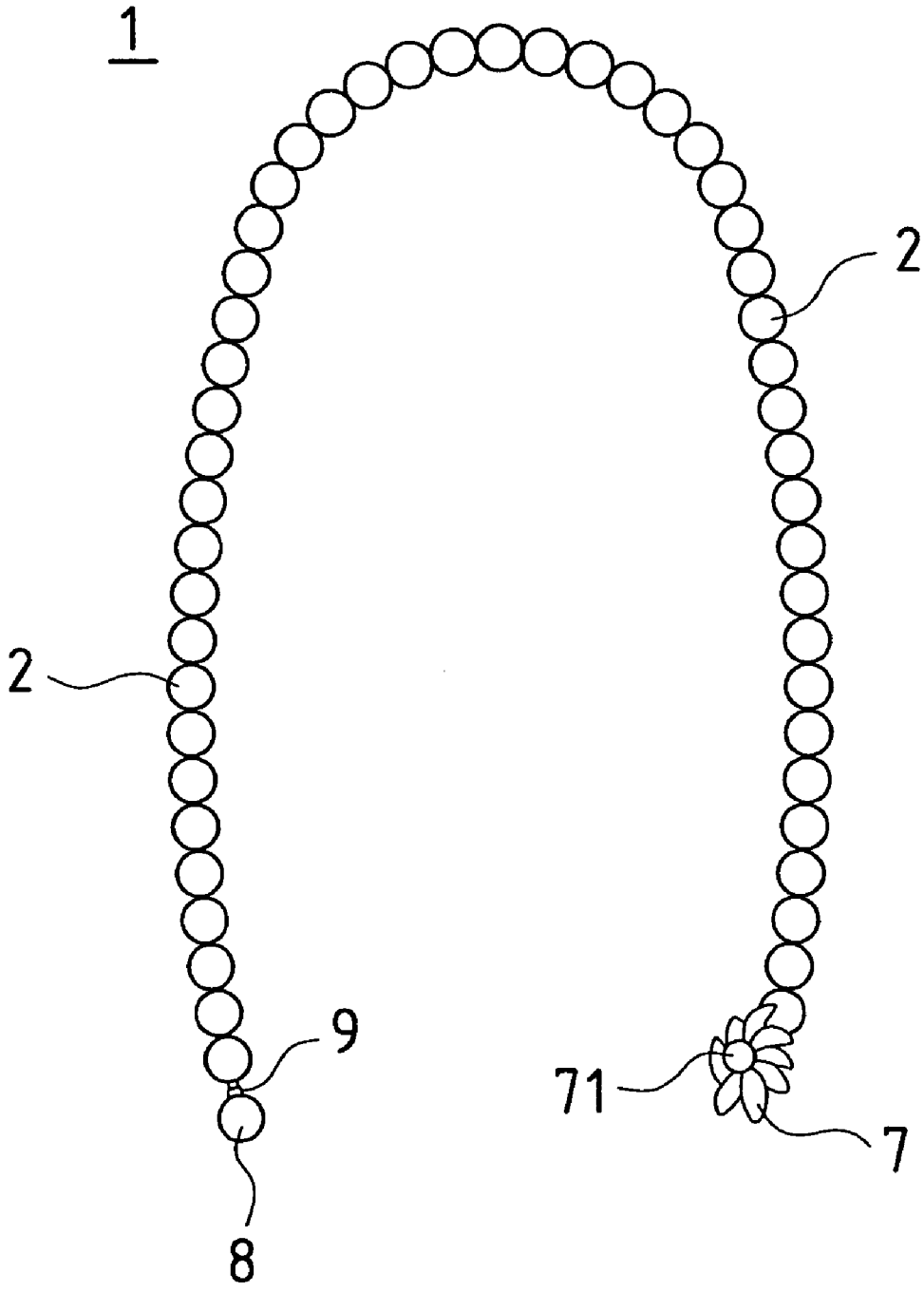
FIG. 1 is a front view showing an embodiment of the accessory according to the present invention.
Figure 2:
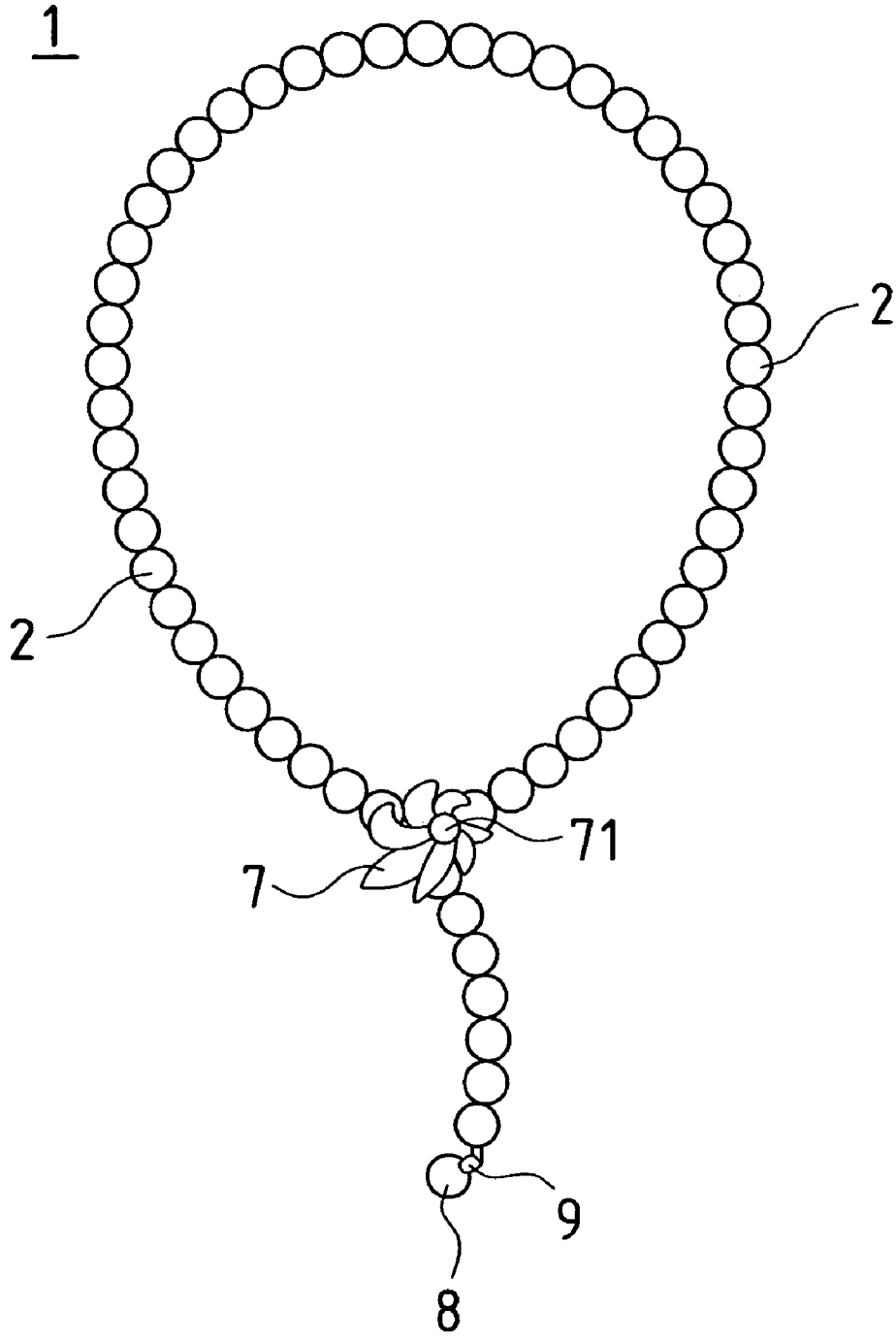
FIG. 2 is a front view showing the accessory of FIG. 1, with the accessory forming a loop.
Figure 7:
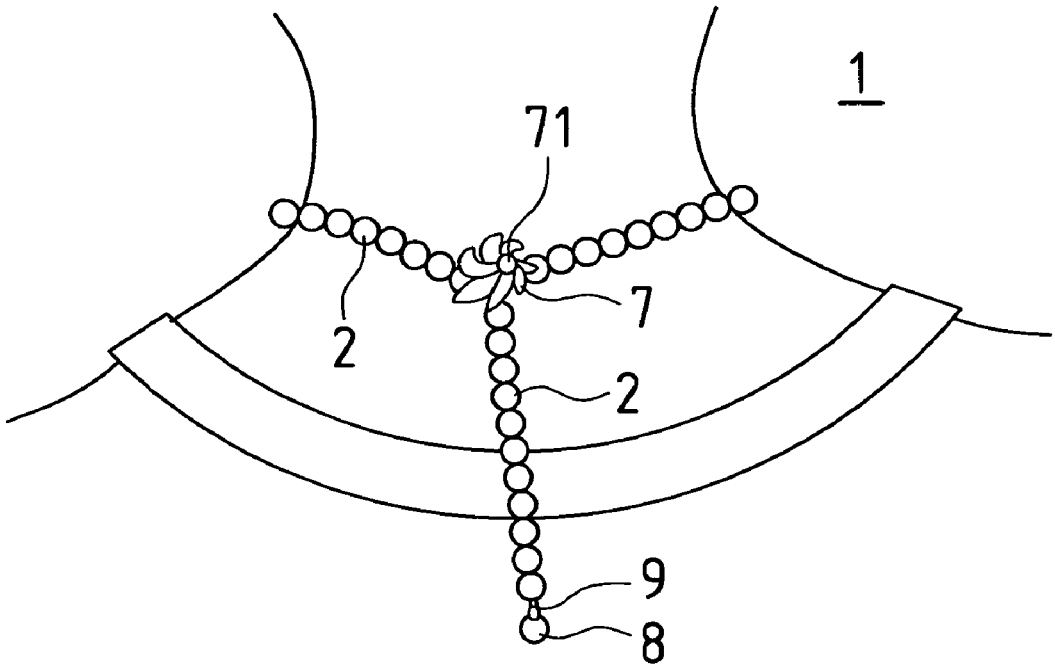
FIG. 7 illustrates an exemplary manner of wearing the accessory.

FIG. 1 shows an example of a pearl necklace 1. As shown in FIG. 2, this necklace can form a loop in the process of being put on, with its loop size being freely adjustable in the process where the necklace is put on. While the necklace is worn, the joint of the loop may locate on the front, or on the back as shown in FIG. 7. Its location is decided freely by wearer's preference.

This necklace 1 comprises a multiplicity of pearls 2, a thread 3, a plurality of spacers 4, a hook 5, linking means 6 and an ornament 7.

Similar to conventional pearl necklaces, each of the pearls 2 has a through hole for pulling a thread. The number of pearls 2 can be suitably determined in accordance with the overall length of the necklace 1 and the size of the pearls 2.

The thread 3 serves to string the multiplicity of pearls 2 in a row. As in conventional pearl necklaces, this thread is made of silk, but it may be made of other fibers or a metal wire.

Figure 5:
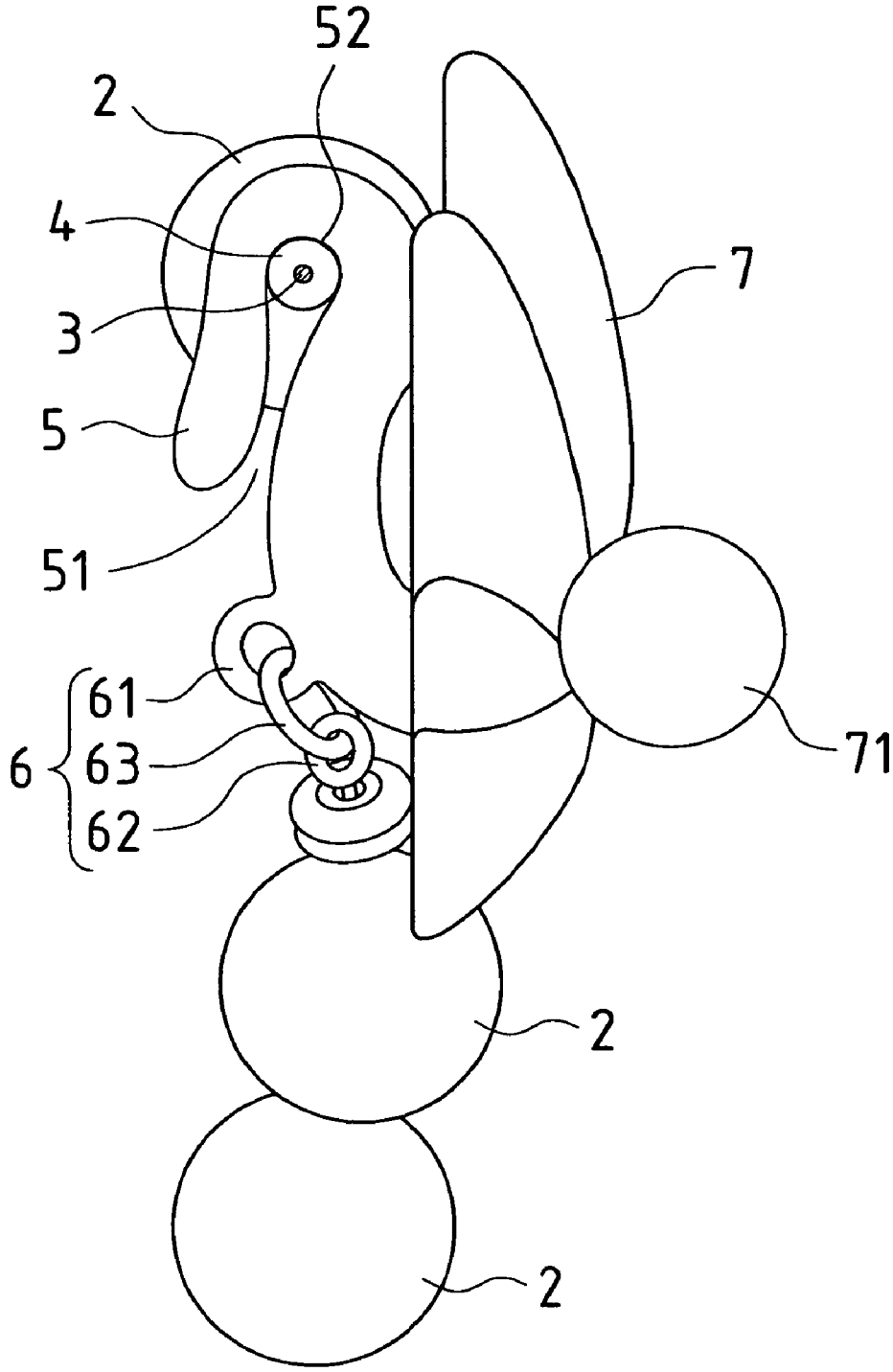
FIG. 5 is a view taken in the direction of arrow lines V—V in FIG. 4.

The spacers 4 serve to receive the hook 5. The spacers 4, which are mounted on the thread 3 between the pearls 2, need only to locate at least in a predetermined section at one end of the thread 3. In this embodiment, although details are not shown in the drawings, the spacers are disposed between all of the pearls 2. Where the spacers 4 are disposed between all of the pearls 2, no undesired gap appears between the pearls 2, avoiding unattractive exposure of the thread 3. It should be noted that the "predetermined section" means a range where the hook 5 is actually latchable on the necklace 1 in the process where the necklace 1 is put on. To be specific, this range originates from one end of the thread 3 and covers a dimension which corresponds to the difference between the overall length of the necklace 1 and the neck size of a standard person. Each spacer 4 is made of an elastic member and has a ring form as shown in FIG. 5. Its inner diameter is only slightly greater than the outer diameter of the thread 3, in order that each spacer 4 does not shake heavily around the thread 3. The outer diameter of each spacer 4 is designed to make it unnoticeable.

Figure 3:
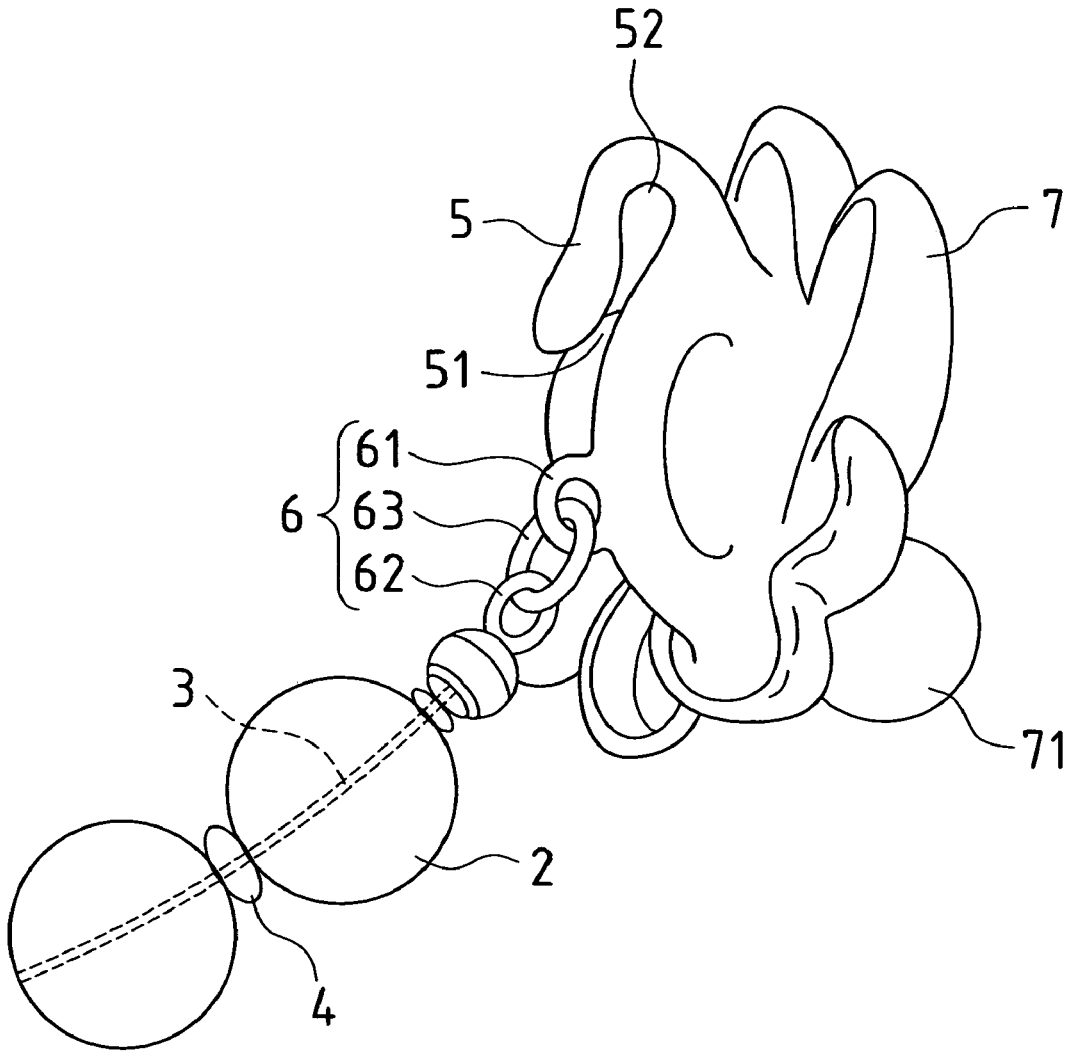
FIG. 3 is a partially enlarged perspective view showing a hook and an ornament.
Figure 4:
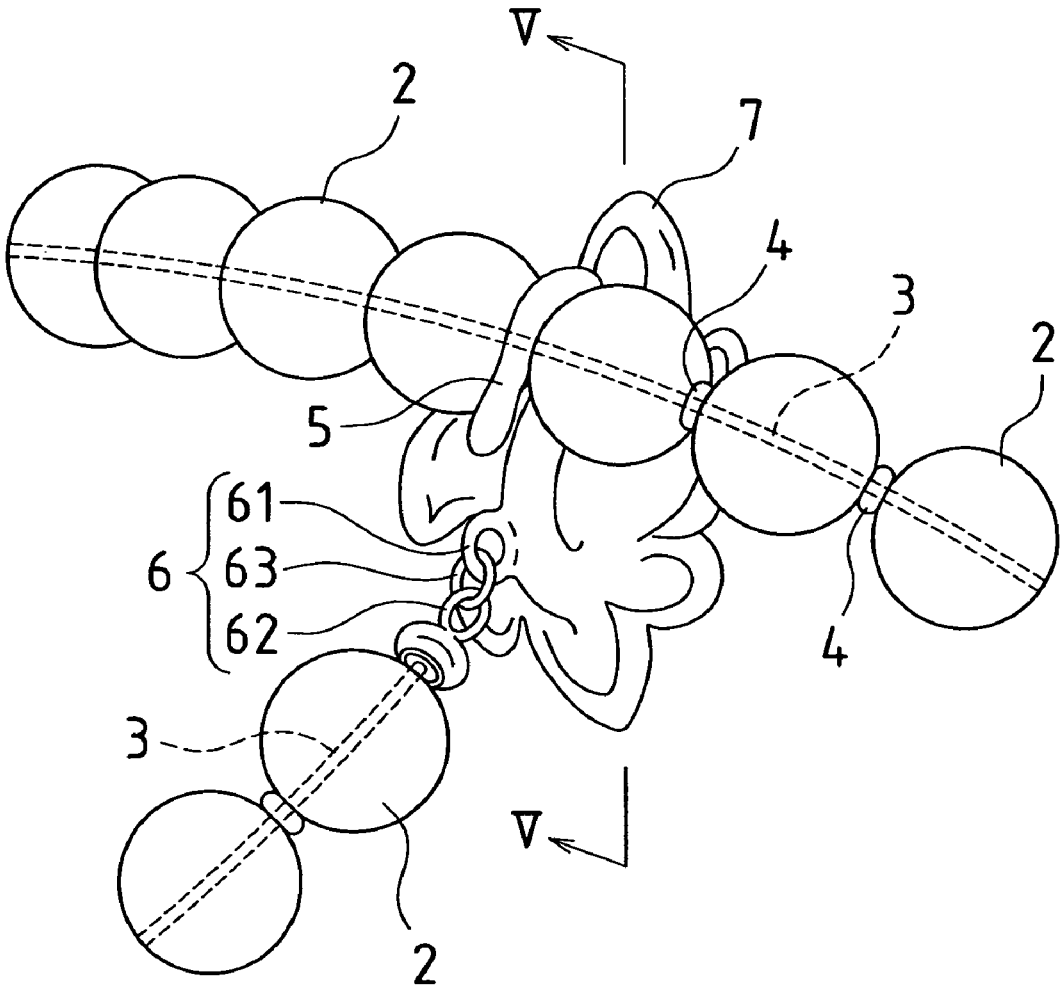
FIG. 4 is a partially enlarged perspective view showing a joint of a loop formed by the accessory, as viewed from the back.

The hook 5, as shown in FIG. 2, FIG. 4 and FIG. 7, serves to latch between the pearls 2 at an optional position in the above-defined predetermined section of the necklace 1. Referring to FIG. 3 and FIG. 5, the hook 5 has an open end 51 whose opening is smaller than the outer diameter of the spacers 4. Opposite to the open end 51 and at the innermost area of the hook 5, the hook 5 also has a spacer fitting area 52 which is defined by a curve that matches the external circumference of the spacers 4. The hook 5 has a smooth surface and such a thickness as to be comfortably inserted between the pearls 2. Thus, the hook 5 avoids damaging the pearls 2.

The linking means 6 serves to link the hook 5 rotatably with the other end of the thread 3. As shown in FIG. 3 to FIG. 5, the linking means 6 of this embodiment is composed of a hooking hole 61 formed at the basal end of the hook 5, an end ring 62 attached at the other end of the thread 3, and a link 63 linking the hooking hole 61 and the end ring 62. This allows the hook 5 to rotate freely at the terminal end of the thread 3.

Figure 6:
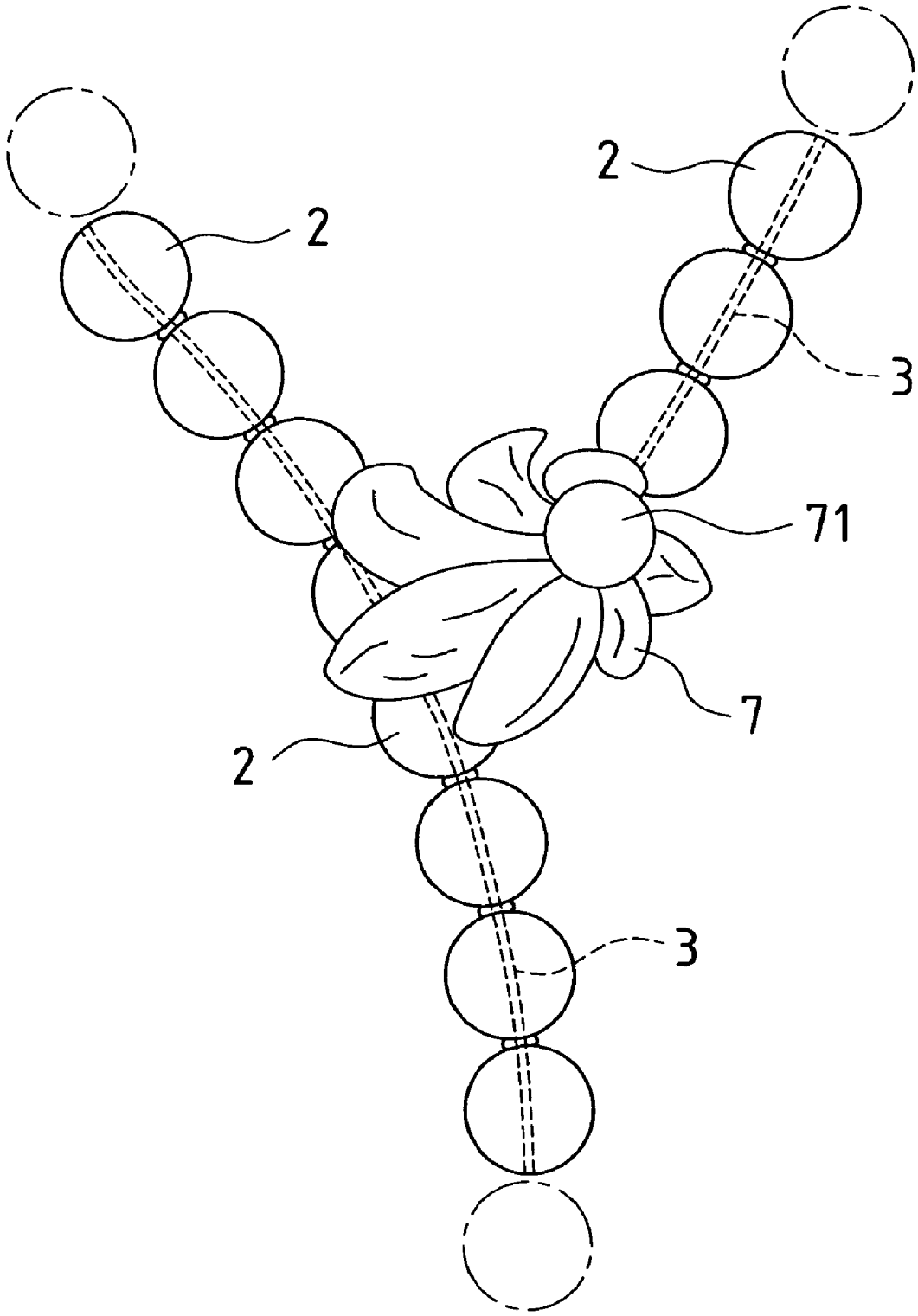
FIG. 6 is a partially enlarged perspective view showing a joint of a loop formed by the accessory, as viewed from the front.

When the hook 5 is inserted between any optional two pearls 2 in the predetermined section and engaged with the spacer between the optional pearls 2, the ornament 7 serves to hide engagement between the hook 5 and the spacer, as shown in FIG. 2, FIG. 6 and FIG. 7. The ornament 7 is attached to the hook 5 in such a manner as to locate behind the hook 5. In this embodiment, the ornament 7 is integrated with the hook 5 and formed as a flower-shaped brooch. In the drawings, the reference sign 71 indicates an independent pearl mounted on the surface of the ornament 7. The shape of the ornament 7 is not limited to the one mentioned herein, but its shape is optional as far as being large enough to hide the engagement.

The reference sign 8 in FIG. 1, FIG. 2 and FIG. 7 indicates a decorative pearl which is linked with one end of the thread 3 via a plurality of links 9. The pearl 8 is intended to improve appearance of an end of the necklace 1 which is to dangle while the necklace is worn. Instead of the pearl 8, a different gem may be linked at the one end.

In using this pearl necklace 1, a wearer holds the necklace 1 by both ends, and positions the middle of the necklace 1 on the front or back of the neck. With assuming an intended loop size, the wearer holds the ornament 7 between fingers and inserts the hook 5 between the pearls 2 at one end of the necklace 1, thereby engaging the hook 5 with the spacer 4 which locates between the corresponding pearls. In this manner, the spacer 4 fits in the spacer fitting area 52 at the innermost area of the hook 5, so that both are firmly linked together. Then, according to her preference, the wearer moves the joint to the front, or to the back as shown in FIG. 7. To put off the necklace 1, the wearer holds the ornament 7 between fingers and pulls the hook 5 in a direction opposite to the one for putting on the necklace. As a result, the spacer 4 which has fitted in the spacer fitting area 52 of the hook 5 deforms elastically and comes off from the hook 5. Eventually, the engagement between the hook 5 and the spacer 4 is released.

In the foregoing description, the embodiment of the present invention is described with respect to an exemplary pearl necklace. Nevertheless, it should be understood that the invention is also applicable to necklaces composed of other types of gems. Further, in addition to necklaces, the application may be extended to bracelets. Additionally, the hook 5 may be used singly without the ornament 7.

INDUSTRIAL APPLICABILITY

As described above, the present invention is suitable for pearl and other various necklaces, and bracelets.

What is claimed is:

1. An accessory comprising:

interconnected members, said interconnected members including (i) plural gems each having a through hole, and (ii) a thread passed through said through hole of each of said plural gems so as to form a strand;

an elastically deformable spacer mounted on said thread between two adjacent ones of said plural gems, said elastically deformable spacer having an outer dimension;

a hook defining a passageway to receive said elastically deformable spacer, said passageway having opposite first and second ends and including (i) an opening at said first end, said opening having a dimension that is less than said outer dimension of said elastically deformable spacer, and (ii) a spacer fitting area at said second end; and another elastically deformable spacer mounted on said thread between another two adjacent ones of said plural gems, said another elastically deformable spacer having an outer dimension that is greater than said dimension of said opening at said first end of said passageway, wherein said elastically deformable spacer and said another elastically deformable spacer each have an external configuration, and said spacer fitting area has a configuration that matches said external configuration of each of said elastically deformable spacer and said another elastically deformable spacer, such that as one of said elastically deformable spacer and said another elastically deformable spacer is passed through said passageway from said first end toward said second end said one of said elastically deformable spacer and said another elastically deformable spacer is deformed and then returns to said external configuration within said spacer fitting area so as to lock said hook between said two adjacent ones of said plural gems or said another two adjacent ones of said plural gems.

2. The accessory according to claim 1, further comprising:

linking structure for rotatably linking said hook with one end of said strand.

3. The accessory according to claim 2, further comprising:

an ornament attached to said hook so as to conceal engagement between said hook and said one of said elastically deformable spacer and said another elastically deformable spacer when said one of said elastically deformable spacer and said another elastically deformable spacer is within said spacer fitting area.

4. The accessory according to claim 3, wherein each of said elastically deformable spacer and said another elastically deformable spacer comprises silicone resin.

5. The accessory according to claim 3, wherein said plural gems comprise plural pearls.

6. The accessory according to claim 2, wherein each of said elastically deformable spacer and said another elastically deformable spacer comprises silicone resin.

7. The accessory according to claim 2, wherein said plural gems comprise plural pearls.

8. An accessory comprising:

interconnected members, said interconnected members including (i) plural gems each having a through hole, and (ii) a thread passed through said through hole of each of said plural gems;

an elastically deformable spacer between two adjacent ones of said plural gems, said elastically deformable spacer having an outer dimension; and a hook defining a passageway to receive said elastically deformable spacer, said passageway having opposite first and second ends and including (i) an opening at said first end, said opening having a dimension that is less than said outer dimension of said elastically deformable spacer, and (ii) a spacer fitting area at said second end, wherein said elastically deformable spacer has an external configuration, and said spacer fitting area has a configuration that matches said external configuration, such that as said elastically deformable spacer is passed through said passageway from said first end toward said second end said elastically deformable spacer is deformed and then returns to said external configuration within said spacer fitting area so as to lock said hook between said adjacent ones of said plural gems.

9. The accessory according to claim 8, wherein said elastically deformable spacer is mounted on said thread.

10. The accessory according to claim 8, wherein said spacer fitting area has a configuration that matches said external configuration of said spacer by having a width dimension that is substantially equal to a width dimension of said spacer.

11. The accessory according to claim 10, wherein said elastically deformable spacer is mounted on said thread.

12. An accessory comprising:

interconnected members;

an elastically deformable spacer between two adjacent ones of said interconnected members, said elastically deformable spacer having an outer dimension;

a hook defining a passageway to receive said elastically deformable spacer, said passageway having opposite first and second ends and including (i) an opening at said first end, said opening having a dimension that is less than said outer dimension of said elastically deformable spacer, and (ii) a spacer fitting area at said second end; and linking structure for rotatably linking said hook at an end of said interconnected members, wherein said elastically deformable spacer has an external configuration, and said spacer fitting area has a configuration that matches said external configuration, such that as said elastically deformable spacer is passed through said passageway from said first end toward said second end said elastically deformable spacer is deformed and then returns to said external configuration within said spacer fitting area so as to lock said hook between said adjacent ones of said interconnected members.

13. The accessory according to claim 12, wherein said spacer fitting area has a configuration that matches said external configuration of said spacer by having a width dimension that is substantially equal to a width dimension of said spacer.

14. An accessory comprising:

interconnected members;

an elastically deformable spacer between two adjacent ones of said interconnected members, said elastically deformable spacer having an outer dimension;

a hook defining a passageway to receive said elastically deformable spacer, said passageway having opposite first and second ends and including (i) an opening at said first end, said opening having a dimension that is less than said outer dimension of said elastically deformable spacer, and (ii) a spacer fitting area at said second end; and an ornament attached to said hook so as to conceal engagement between said hook and said elastically deformable spacer when said elastically deformable spacer is within said spacer fitting area, wherein said elastically deformable spacer has an external configuration, and said spacer fitting area has a configuration that matches said external configuration, such that as said elastically deformable spacer is passed through said passageway from said first end toward said second end said elastically deformable spacer is deformed and then returns to said external configuration within said spacer fitting area so as to lock said hook between said adjacent ones of said interconnected members.

15. The accessory according to claim 14, wherein said spacer fitting area has a configuration that matches said external configuration of said spacer by having a width dimension that is substantially equal to a width dimension of said spacer.

16. An accessory comprising:

interconnected pearls;

an elastically deformable spacer between two adjacent ones of said interconnected pearls, said elastically deformable spacer having an outer dimension; and a hook defining a passageway to receive said elastically deformable spacer, said passageway having opposite first and second ends and including (i) an opening at said first end, said opening having a dimension that is less than said outer dimension of said elastically deformable spacer, and (ii) a spacer fitting area at said second end, wherein said elastically deformable spacer has an external configuration, and said spacer fitting area has a configuration that matches said external configuration, such that as said elastically deformable spacer is passed through said passageway from said first end toward said second end said elastically deformable spacer is deformed and then returns to said external configuration within said spacer fitting area so as to lock said hook between said adjacent ones of said interconnected pearls.

17. The accessory according to claim 16, wherein said spacer fitting area has a configuration that matches said external configuration of said spacer by having a width dimension that is substantially equal to a width dimension of said spacer.

18. An accessory comprising:

interconnected members;

an elastically deformable spacer between two adjacent ones of said interconnected members, said elastically deformable spacer having an outer dimension;

a hook defining a passageway to receive said elastically deformable spacer, said passageway having opposite first and second ends and including (i) an opening at said first end, said opening having a dimension that is less than said outer dimension of said elastically deformable spacer, and (ii) a spacer fitting area at said second end; and another elastically deformable spacer between another two adjacent ones of said interconnected members, said another elastically deformable spacer having an outer dimension that is greater than said dimension of said opening at said first end of said passageway, wherein said elastically deformable spacer has an external configuration, and said spacer fitting area has a configuration that matches said external configuration by having a width dimension that is substantially equal to a width dimension of said spacer, such that as said elastically deformable spacer is passed through said passageway from said first end toward said second end said elastically deformable spacer is deformed and then returns to said external configuration within said spacer fitting area so as to lock said hook between said adjacent ones of said interconnected members.

19. An accessory comprising:

interconnected members;

an elastically deformable silicone resin spacer between two adjacent ones of said interconnected members, said elastically deformable silicone resin spacer having an outer dimension; and a hook defining a passageway to receive said elastically deformable silicone resin spacer, said passageway having opposite first and second ends and including (i) an opening at said first end, said opening having a dimension that is less than said outer dimension of said elastically deformable silicone resin spacer, and (ii) a spacer fitting area at said second end;

wherein said elastically deformable silicone resin spacer has an external configuration, and said spacer fitting area has a configuration that matches said external configuration by having a width dimension that is substantially equal to a width dimension of said spacer, such that as said elastically deformable silicone resin spacer is passed through said passageway from said first end toward said second end said elastically deformable silicone resin spacer is deformed and then returns to said external configuration within said spacer fitting area so as to lock said hook between said adjacent ones of said interconnected members.

* * * * *